US007004578B2

(12) United States Patent
Tsuboi et al.

(10) Patent No.: US 7,004,578 B2
(45) Date of Patent: Feb. 28, 2006

(54) PRINTING APPARATUS

(75) Inventors: Hitoshi Tsuboi, Kanagawa (JP); Noribumi Koitabashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,854

(22) Filed: Jun. 19, 2002

(65) Prior Publication Data

US 2003/0011669 A1 Jan. 16, 2003

(30) Foreign Application Priority Data

Jun. 21, 2001 (JP) ..... 2001-188515

(51) Int. Cl.
*B41J 2/01* (2006.01)

(52) U.S. Cl. ..... 347/102; 347/103

(58) Field of Classification Search ..... 347/102, 347/20, 67, 22, 26

See application file for complete search history.

(56) References Cited

U.S. PATENT DOCUMENTS 5,502,464 A 3/1996 Takahashi et al.
6,126,281 A * 10/2000 Shimoda et al. ..... 347/101

FOREIGN PATENT DOCUMENTS

JP 11-342598 * 12/1999

* cited by examiner

*Primary Examiner*—Stephen Meier
*Assistant Examiner*—Ly Tran
(74) *Attorney, Agent, or Firm*—Fitzpatrick, Cella, Harper & Scinto

(57) ABSTRACT

In a printing apparatus, such as a full-multi-type printing apparatus, if a heating device is used to heat a printing medium near a print head performing a printing operation by ejecting ink, the heating device is provided under a back surface of the printing medium located opposite to a face of the print head except for neighborhoods of ejection ports that eject printing material.

26 Claims, 13 Drawing Sheets

PRINTING APPARATUS

This application is based on Patent Application No. 2001-188515 filed Jun. 21, 2001 in Japan, the content of which is incorporated hereinto by reference.

BACKGROUND OF THE INVENTION

1. Field of the Invention

The present invention relates to a printing apparatus having a print head mounted therein, and in particular, to a printing apparatus having a print head mounted therein and also having heating means such as a heater for heating the printing medium to dry a printing liquid such as ink.

2. Description of the Related Art

Conventional ink jet printing apparatuses eject ink droplets as a printing liquid from a print head directly onto a printing medium and deposit the ink droplets on surfaces of the printing medium for printing thereon. Because of their simple mechanisms for printing, these ink jet printing apparatuses are frequently used in printers, copiers, or the like. Furthermore, in many of these ink jet printing apparatuses, the printing liquid deposited on the printing medium is naturally dried to fix print images on the surfaces of the media.

Further, in these ink jet printing apparatuses, thermal drying means of the printing liquid is effective means for preventing the printing liquid from bleeding at edges of a print image on a printing medium, allowing the print image to be fixed quickly to the printing medium, improving the density of the print image, or the like. If such means is used, the ink jet printing apparatus is provided with heating means such as a heater for heating portions of the printing medium which are near the print head.

In an ink jet printing apparatus mounted with a print head, a surface of the print head is located opposite to a printing medium such as a print sheet and is called a "face". The face of the print head has ejection ports formed therein to eject the printing liquid onto the printing medium therethrough. Thus, the printing liquid is ejected onto the front surface of the printing medium through the ejection ports of the print head to print onto the printing medium. Further, in the case of thermally drying the printing liquid, some ink jet printing apparatuses are provided with a heater or the like which heats portions of the printing medium which are near the print head. A typical location where the heater or the like is provided includes a front surface of a platen corresponding to the back surface of the printing medium, located opposite to the face of the print head, and the bottom of the platen. Another proposed location for the heater or the like is one immediately adjacent to the print head which corresponds to the top of the surface of the printing medium, which has just been printed by the print head. Moreover, such a heater or the like simultaneously heats portions of the printing medium which are near the portions to be printed.

The inventors have experimentally found that while the printing liquid ejected from the print head is permeating through the printing medium after being deposited on the printing medium, heating carried out as early as possible more effectively prevents the printing liquid from bleeding at the edges of the print image on the printing medium, allows the print image to be more quickly fixed by facilitating drying and permeation, and concentrates the color material of the printing liquid in the vicinity of the front surface of the printing medium in order to improve the density of the print image. When the color material of the printing liquid concentrates in the vicinity of the front surface of the printing medium, the amount of color material of the printing liquid present in a deep layer of the printing liquid which is close to the back surface of the printing medium decreases to avoid making the print image visible through the back surface of the printing medium, thereby improving the practicality of double-side printing These effects are marked particularly if the heater is mounted near the portions of the printing medium to be printed.

However, such an arrangement of the heater is not preferable because a heating section is located near to the print head, which may thus be heated. In particular, if the heater is mounted on the front surface of the platen corresponding to the back surface of the printing medium, located opposite to the face of the print head, or is provided at the bottom of the platen, the time required after the printing liquid from the print head has been deposited on the printing medium and before it is fixed is reduced to improve a thermal fixation effect, but the print head is heated by the heater, located immediately adjacent to the face of the print head. Thus, this configuration is more undesirable. Compared to the case in which the heater is mounted immediately adjacent to the print head, that is, above the front surface of the printing medium, which has just been printed, the case is particularly preferable in which the heater is mounted on the front surface of the platen corresponding to the back surface of the printing medium, located opposite to the face of the print head, or is mounted at the bottom of the platen, because the time required after the printing liquid from the print head has been deposited on the printing medium and before heating is started can be shortened, thereby eliminating the need to provide a space immediately adjacent to the print head in which the heater is mounted. If the amount of space that must be provided immediately adjacent to the print head can be reduced, then if a plurality of print heads are mounted, the interval between the print heads can be reduced, or the size of the printing apparatus can be reduced. But, the print head has ejection ports formed in the face thereof, so that a change in environment such as temperature or humidity is likely to affect ejection of the printing liquid. If the heater is mounted on the front surface of the platen corresponding to the back surface of the printing medium, located opposite to the face of the print head, or is mounted at the bottom of the platen, the printing liquid is prone to be heated at the ejection ports of the print head and have its physical properties changed before ejection. Consequently, there are possibilities that the printing liquid may be inappropriately ejected, the nature of the liquid on the printing medium may be changed, or the like. In particular, at the ejection ports of the print head, the heat causes the moisture of the printing liquid to be evaporated to be apt to dry the printing liquid for concentration.

The print head of the ink jet printing apparatus has a liquid channel formed therein and through which the printing liquid flows. When the printing head is heated, the temperature in the liquid channel rises to heat the printing liquid in the liquid channel. When the printing liquid in the liquid channel is thus heated, the viscosity of the printing liquid or the like may change, the physical properties of the printing liquid may change owing to alteration, or the like. Further, such heating may cause a gas dissolved in the printing liquid to be emitted from the printing liquid or may cause the printing liquid to be vaporized to generate bubbles in the printing liquid, thereby preventing the liquid from being delivered through the print head or being properly ejected.

On the other hand, the print head is often comprised of plastic or the like, which is not resistant to heat. This is because the print head can be inexpensively and easily made by entirely or partially forming its nozzle portion using plastic However, plastic or the like generally has low heat conduction and radiation, so that when exposed to high temperatures, the print head has its temperature easily increased. Further, if the print head is comprised of plastic having high heat conductivity and resistance, then material costs will increase or processing will be difficult. Accordingly, it is desirable to use a print head formed of the same material as that for conventional print heads. Further, circuit elements constituting an electronic circuit in the print head are also likely to be affected by heat. Consequently, if the print head is exposed to high temperatures and has its temperature increased, the print head member may be deformed or damaged, or the electronic circuit or the like in the print head may have its properties changed or may be damaged, thus irreversibly destroying the print head. In particular, if printing speed is increased, for example, if printing is carried out with a smaller number of passes, then the time spent in heating each portion of the printing medium is reduced, it results in the need to fix the print image to the printing medium by heating the printing medium at higher temperatures. Therefore, additional means is required for preventing the print head from being heated together with the printing medium even if the latter is heated at high temperatures, for allowing the printing medium to be efficiently heated with a reduced amount of energy, or the like.

Thus, in order to solve the above described problems of the conventional ink jet printing apparatuses, it is an object of the present invention to provide a printing apparatus in which when printing media are heated by using heating means such as a heater in order to fix a printing liquid to the printing media, an increase in temperature of the print head caused by such heating means is properly suppressed.

It is another object of the present invention to provide a printing apparatus that can efficiently fix a printing liquid to printing medium by effectively using heat from heating means such as a heater.

SUMMARY OF THE INVENTION

In order to attain the above object, a printing apparatus of the present invention in which if heating means is used to heat a printing medium near a print head performing a printing operation by ejecting ink, the heating means is provided under a back surface of the printing medium located opposite to a face of the print head but is not arranged in neighborhoods of ejection ports for printing material, thereby enabling easy heating in a small area between the print head and the printing medium or in neighborhoods of a printed portion and minimizing heat received by peripheries of the ejection ports in the face of the print head. Therefore, the print head can be appropriately protected from heat.

The printing apparatus of the present invention is a full-multi-type printing apparatus in which if heating means is used to heat a printing medium near a print head performing a printing operation by ejecting ink, the heating means is provided under a back surface of the printing medium located opposite to a face of the print head but is not arranged in neighborhoods of ejection ports for printing material, so that if heating means such as a heater is used to heat the printing medium near the print head, the heating means can be provided under the back surface of the printing medium, located opposite to the face of the print head except for neighborhoods of ejection ports for printing material, thereby preventing the ejection ports in the face of the print head from being heated to suitably protect the print head.

The printing apparatus of the present invention is an ink jet printing apparatus in which if heating means is used to heat a printing medium near a print head performing a printing operation by ejecting ink, the heating means is provided under a back surface of the printing medium located opposite to a face of the print head but is not arranged in neighborhoods of ejection ports for printing material, so that if heating means such as a heater is used to heat the printing medium near the print head, the heating means can be provided under the back surface of the printing medium, located opposite to the face of the print head except for neighborhoods of ejection ports for printing material, thereby preventing the ejection ports in the face of the print head from being heated to appropriately protect the print head.

The printing apparatus of the present invention is a full-multi-type ink jet printing apparatus in which if heating means is used to heat a printing medium near a print head performing a printing operation by ejecting ink, the heating means is provided under a back surface of the printing medium located opposite to a face of the print head except for neighborhoods of ejection ports for printing material, so that if heating means such as a heater is used to heat the printing medium near the print head, the heating means can be provided under the back surface of the printing medium, located opposite to the face of the print head except for neighborhoods of ejection ports for printing material, thereby properly protecting the ejection ports in the face of the print head from heat.

In the printing apparatus of the present invention, the neighborhoods of the ejection ports refer to an area covered by a specified angle or larger with respect to a direction perpendicular to the ejection ports, so that the neighborhoods of the ejection ports can be suitably protected from heat.

In the printing apparatus of the present invention, if the heating means is used to heat the printing medium near the print head, a heat reflecting plate is provided on a surface of the print head which is opposite to the heating means, thereby suitably protecting the face of the print head from heat.

In the printing apparatus of the present invention, if the heating means is used to heat the printing medium near the print head, a heat reflecting plate, a heat conducting plate and a radiator plate are provided on a surface of the print head which is opposite to the heating means, thereby suitably protecting the face of the print head from heat.

The printing apparatus of the present invention is provided with a plate having a combination of some functions of the heat reflecting plate, heat conducting plate, and radiator plate, thereby enabling the number of parts to be reduced to lessen production costs.

In the printing apparatus of the present invention, the neighborhood of the ejection ports refers to an entire area occupied by through-holes in the heat reflecting plate, which are located near the ejection ports, the area being covered by a specified angle or larger with respect to a direction perpendicular to the ejection ports. Therefore, heat received by peripheries of the ejection ports in the face of the print head can be minimized to appropriately protect the print head from heat.

The printing apparatus of the present invention has a heat reflecting plate provided on the face with nozzles or on the face and on areas of the print head which are near the face, and heating means provided opposite to the face to heat a printing medium. The printing medium is passed between the heat reflecting plate on the face and the heating means opposite to the face, so that part of heat from the heating means opposite to the face which has been transmitted through the printing medium is reflected by the heat reflecting plate on the face, and the reflected heat is used to heat the printing medium again. Consequently, the face of the print head can be appropriately protected from heat.

The printing apparatus of the present invention has a heat reflecting plate provided on the face with the nozzles or on the face and on areas of the print head which are near the face, and heating means provided opposite to the face to heat a printing medium, the printing medium is passed between the heat reflecting plate on the face and the heating means opposite to the face so that that part of heat from the heating means opposite to the face which has been transmitted through the printing medium is reflected by the heat reflecting plate on the face, and the reflected heat is used to heat the printing medium again, while the heat transmitted through the printing medium is returned to the heating means, located opposite to the face. Consequently, an increase in temperature of the print head caused by the heating means can be suppressed, and the heat from the heating means can be effectively used to efficiently fix the printing liquid to the printing medium, thereby performing a good printing operation.

In the printing apparatus of the present invention, a thin metal film is attached to the print head as a heat reflecting plate, thereby allowing the heat reflecting plate to be properly produced and enabling the print head to be properly protected.

In the printing apparatus of the present invention, a metal plate is attached to the print head so as to be used as a heat reflecting plate and a heat conducting plate and a radiator plate, thereby allowing the heat reflecting plate to be suitably produced and enabling the print head to be suitably protected.

In the printing apparatus of the present invention, the surface of the print head partially or entirely consists of metal, and can thus be properly protected from heat.

In the printing apparatus of the present invention, metal is directly deposited on the surface of the print head to form a thin metal film as a heat reflecting plate, thereby allowing the heat reflecting plate to be appropriately produced and enabling the print head to be suitably protected.

In the printing apparatus of the present invention, an electric wire with a high reflectance is-attached to the print head as a heat reflecting plate, thereby allowing the heat reflecting plate to be inexpensively made. The printing apparatus is characterized in that if heating means is used to heat a printing medium near a print head performing a printing operation by ejecting ink, the heating means is provided under a back surface of the printing medium located opposite to a face of the print head except for neighborhoods of ejection ports for printing material.

In the printing apparatus of the present invention, material other than metal which has a high heat reflectance is used as a heat reflecting plate, thereby allowing the heat reflecting plate to be inexpensively and suitably produced.

In the printing apparatus of the present invention, material with high heat reflectance is applied directly to the surface of the print head to form a thin heat-reflecting film, thereby preventing the peripheries of the ejection ports in the surface of the print head from being heated to thermally affect the print head.

In the printing apparatus of the present invention, the heating means is not provided in neighborhoods of the ejection ports, but the heat reflecting plate, heat conducting plate and radiator plate are provided under the back surface of the printing medium and in neighborhoods of the ejection ports, with the heating means provided under the heat reflecting plate and others and opposite to the print head. Therefore, heat from the heating means can be reflected to the printing medium by the heat reflecting plate of the print head, thereby avoiding thermally affecting the print head.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 1:
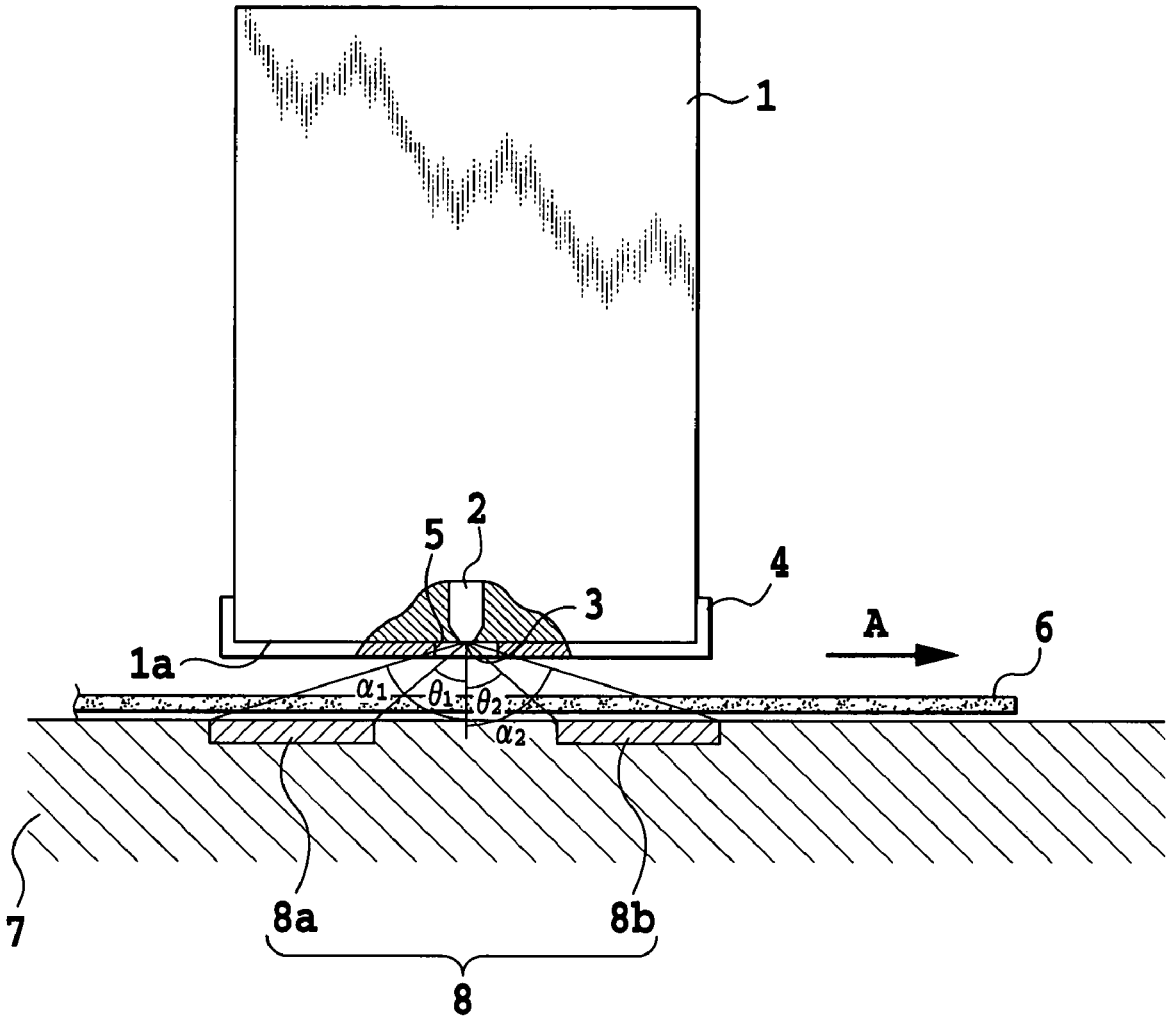
FIG. 1 is a partial sectional side view showing Embodiment 1 of a printing apparatus of the present invention as well as the positional relationship between a print head 1 and a printing medium, a platen and a heater.

According to a printing apparatus of the present invention constructed as described above, a heat reflecting plate having through-holes formed in peripheries of ejection ports so as not to hinder a printing liquid from being ejected is provided on a face of a print head. Further, heating means is provided on that part of a front surface of a platen which is opposite to the face of the print head, or under the platen, so as to be opposite to the face of the print head, but the heating means is not arranged in an area opposite to the through-holes and an area covered by a certain angle with respect to a direction perpendicular to the through-holes. Alternatively, an arrangement is provided such that heat from the heating means can be reflected to a printing medium by the heat reflecting plate of the print head. Furthermore, an arrangement is provided such that the peripheries of the ejection ports in the face of the print head are subjected to only a small amount of heat from portions of the heating means which are located obliquely to these peripheries Preferably, to prevent the peripheries of the ejection ports in the face of the print head from being heated to thermally affect the print head, a heat conducting plate is provided so as to extend from the peripheries of the ejection ports in the face of the print head to sides of the print head in such a manner that a printing liquid is not prevented from being ejected. Moreover, a radiator plate is provided so as to cover the sides of the print head, or the heat reflecting plate, heat conducting plate, and radiator plates are integrated together. It is also preferable that by forming the above described construction to prevent from heating the heat reflecting plate to thermally affect the print heads the heat conducting plate is provided so as to extend from the heat reflecting plate to the sides of the print head, or a radiator plate is provided so as to cover the sides of the print head, or the heat reflecting plate, heat conducting plate and radiator plates are integrated together.

Further, preferably, in a printing apparatus such as a full-multi-type printer, which has a fixed print head, heating means such as a heater can be fixed and thus relatively easily provided. Furthermore, a serial printer, which has a movable print head, preferably has heating means such as a heater which moves on a platen together with the print head or heating means that achieves sufficient heating at high speeds.

In the printing apparatus of the present invention constructed as described above, a printing medium is heated by heating means such as a heater so that heat from the heating means can be absorbed by the printing medium, and heat transmitted through the printing medium is reflected by the reflecting plate of the print head to heat the printing medium again. Furthermore, heat transmitted through the printing medium is used to heat the heating means to prevent the temperature thereof from decreasing, thereby maintaining a large amount of thermal radiation therefrom. Alternatively, the direction of heat reflection is changed to heat all areas of the printing medium except the one between the heating means and the heat reflecting plate. Further, the print head is provided with the heat reflecting plate so as to be protected from heat. Consequently, each portion of the print head is subjected to heat that is cos θ times as high as that radiated from heating means covering an angle θ with respect to a direction perpendicular to this portion. Thus, if the heating means is not provided in that area opposite to through-holes in the heat reflecting plate which are located in peripheries of the ejection ports in the face of the print head, or in the area being covered by the angle θ, then heat received by the peripheries in the face of the print head can be minimized.

Further, the heat reflecting plate enables easy heating in the narrow area between the print head and the printing medium and of neighborhoods of printing portions.

The other objects, features and advantages of the present invention will be apparent from the detailed description of several embodiments taken in conjunction with the accompanying drawings.

Several embodiments of a printing apparatus of the present invention will be described below in detail with reference to the drawings.

(Embodiment 1)

FIG. 1 schematically shows Embodiment 1 of a printing apparatus according to the present invention. The printing apparatus of the illustrated embodiment is constructed so that a print head having substantially the same width as the full width of a printing medium having the largest width among those printing media which can be printed by this printing apparatus is fixed to a fixing member such as a frame, and a printing medium is fed to the fixed print head, while the print head is being used to form a print image on the printing medium, thereby achieving full-multi-type printing.

As shown in FIG. 1, the printing apparatus to which the present invention is applied has a print head 1 mounted therein and having the same width as the full width of a print sheet 6 as a printing medium which has the largest width among those print media which can be printed by this printing apparatus. The print head 1 has a plurality of nozzles 2 contiguously formed therein in parallel with a cross direction of the print head 1, and an ejection port 3 located at the tip of each nozzle 2 is opened in a face 1*a* of the print head 1. Further, the print head 1 has a heat reflecting plate 4 attached to the face 1*a* by adhesion or junction and having a high heat reflectance. The heat reflecting plate 4 can also act as both a heat conducting plate and a radiator plate to protect the face 1*a* from heat. The heat reflecting plate 4 has through-holes 5 formed in those portions thereof which correspond to the ejection ports 3, each through-hole 5 corresponding to each corresponding ejection port 3 Each of the through-holes 5 is larger than the ejection port 3 and is formed so that the interior of the nozzle 2 is in communication with the exterior thereof via the through-hole 5. The heat reflecting plate 4 can be composed of a metal plate such as aluminum, which appropriately reflects heat, to also act as a heat conducting plate, a radiator plate, or the like as required. Further, a nozzle portion including the nozzles 2 and ejection ports 3 of the print head 1 can be partially or entirely composed of plastic so as to be easily processed.

A surface of the heat reflecting plate 4 which is opposite to the print head 1, that is, which faces the print sheet 6 as a print medium is located opposite to a front surface of a platen 7 of the printing apparatus. The platen 7 has a heater as heating means embedded in a portion of a front layer thereof which is opposite to the heat reflecting plate 4. In the embodiment shown in FIG. 1, the heater 8 is composed of a pair of heaters 8*a* and 8*b* arranged so as to be embedded in the front surface of the platen 7 with a space provided therebetween, the heaters being located on the upstream and downstream sides, respectively, of the ejection ports 3 of the nozzles 2, with respect to the direction in which the print sheet 6 as a printing medium is transported. A printing area is located between the ejection ports 3 and those portions of the heaters 8*a* and 8*b* which are opposite to the ejection ports 3. When the heaters 8*a* and 8*b* are embedded in the platen 7 as shown in the drawings, the heater 8 as heating means is constructed immediately below the print head 1. Alternatively, the front layer of the platen 7 may be composed of a net or transparent layer through which heat is transmitted, or a heat conductor or the like, and under which a heater as heating means can be provided.

The print sheet 6 as a printing medium is transported in a direction parallel with the front surface of the platen 7 and shown by arrow A so as to pass between the heat reflecting plate 4 and the platen 7. When the print sheet 6 passes through the printing area, a printing liquid such as ink is ejected through the ejection ports 3 of the print head 1 to form a print image on a surface of the print sheet 6 facing the print head 1.

Accordingly, if the heater 8 (8*a*, 8*b*) has a smooth surface formed of non-metal or metal oxide, heat is uniformly radiated in all directions of the heater 8 (8*a*, 8*b*). This heat radiation energy varies in proportion to the fourth power of the absolute temperature of this surface, so that the heat radiation from this surface becomes dominant. Consequently, each portion of the print head 1 receives heat cos θ times as high as heat radiation from the direction of an angle θ, per unit area of this portion. The total heat received by a certain portion of the print head 1 can be calculated by integrating radiated heat from all visible directions from this portion. If the print sheet 6 as a printing medium is not located between the heater 8 (8*a*, 8*b*) and the print head 1, neither heat absorption nor scattering nor reflection occurs between the heater 8 (8*a*, 8*b*) and the print head 1, and the portion of the heater 8 (8*a*, 8*b*) is sufficiently hotter than the other portions, then heat radiation from the portions other than the heater 8 (8*a*, 8*b*) is negligible since the heat radiation energy is in proportion to the fourth power of the absolute temperature of the surface, and the above mentioned total heat can be approximated using only the heat radiation from the portion of the heater 8 (8*a*, 8*b*).

In the print head 1 in FIG. 1, radiated heat near each ejection port 3 amounts to the quantity of heat obtained by multiplying together, for the angle θ of cos θ, integrated values for between an angle $\theta_1$ and an angle $\alpha_1$ and between an angle $\theta_2$ and an angle $\alpha_2$ provided that the heater 8 (8*a*, 8*b*) extends to a point at infinity all over the front surface of the platen 7. Accordingly, a calculation results in $(\sin\alpha_1+\sin\alpha_2-\sin\theta_1-\sin\theta_2)/2$ times. If each of the angles $\theta_1$ and $\theta_2$ is 30°, heat radiation near the ejection port 3 is reduced to half compared to the case in which the heater 8 (8*a*, 8*b*) extends to a point at infinity all over the front surface of the platen 7. If each of the angles $\theta_1$ and $\theta_2$ is 30°, the distance between the face 1*a* and the front surface of the platen 7, in which the heater 8 (8*a*, 8*b*) is present, is 1 mm, and the distance between a position immediately below the ejection port 3 and an end of the heater 8 (8*a*, 8*b*), which corresponds to the angles α1 and α2, is 10 mm, then a calculation results in 0.495 times. Furthermore, if the through-hole 5 in the heat reflecting plate 4 has a width of 2 mm near the ejection port 3, then by simply avoiding installing the heater 8 (8*a*, 8*b*) in a 3 mm space immediately below the ejection port 3, each of the angles $\theta_1$ and $\theta_2$ is 30° or larger in all areas in the face 1*a* which are near the ejection ports 3 and which correspond to those portions of the heat reflecting plate 4 in which the through-holes 5 are opened. This means that half the amount of heat is received by those areas in the face 1*a* which are near of the ejection ports 3 and which correspond to portions of the heat reflecting plate 4 in which the through-holes 5 are opened.

In this case, if the print sheet 6 as a printing medium is transported at a speed of 170 mm/s, 8.8 msec is required after the print sheet 6 has been printed by the print head 1 and before heating by the heater 8 (8*a*, 8*b*) is started followed by transportation by 1.5 mm. If overlapping ink having a permeation speed Ka of 1 $\mu$m/msec$^{1/2}$ or less or semi-permeating ink having a permeation speed Ka between 1 and 5 $\mu$m/msec$^{1/2}$ is used, the ink remains on a surface of the print sheet 6 and is heated and fixed before completely permeating through the print sheet 6, resulting in a change of printing quality. Consequently, the heating and fixation suppresses the permeation of the printing liquid through the print sheet 6 to increase the amount of printing liquid remaining on the surface of the print sheet 6, while inhibiting the printing liquid from bleeding, thereby improving image quality.

By thus avoiding providing of the heater 8 (8*a*, 8*b*) in the area covered by the angles $\theta_1$ and $\theta_2$ with respect to neighborhoods of the ejection ports 3 in the area in which the through-holes 5 in the heat reflecting plate 4 are open, the heat received by the neighborhoods of the ejection ports 3 can be substantially reduced to suppress an increase in temperature thereof. This enables the neighborhoods of the ejection ports 3 to be kept within an appropriate temperature range for ejection of the printing liquid.

Thus, in the printing apparatus, when the print sheet 6 passes between the heater 8 (8*a*, 8*b*) and the heat reflecting plate 4, heat generated by the heater 8 (8*a*, 8*b*) is absorbed by the printing liquid applied to the print sheet 6. Furthermore, heat generated by the heater 8 (8*a*, 8*b*) and having passed through the print sheet 6 is reflected to the print sheet 6 by the heat reflecting plate 4 on the face 1*a*. Consequently, heat having passed through the print sheet 6 is reflected by the heat reflecting plate 4 and thus used again to heat the print sheet 6 and the printing liquid applied thereto. Further, part of the heat reflected by the heat reflecting plate 4 and passed through the print sheet 6 again reaches the heater 8 (8*a*, 8*b*) to heat it. In this manner, part of the heat reflected by the heat reflecting plate 4 is used to heat the heater 8 (8*a*, 8*b*), thereby preventing a decrease in temperature of the heater 8 (8*a*, 8*b*).

In FIG. 1, the heater 8 is composed of the upstream heater 8*a* and the downstream heater 8*b*. The heater 8*a* is located under an area immediately before the area in which the print sheet 6 as a printing medium is printed. The heater 8*a* is somewhat effective in drying the print sheet 6 to allow ink to permeate appropriately through the print sheet even if the temperature of the print sheet 6 increases, but the thermal fixation effect is weak when the print sheet 6 has a smaller specific heat value than the printing liquid. Accordingly, the thermal fixation is more effective when each printing liquid, having a larger specific heat value, is heated by the heater, so that the heater 8 may be composed of only the downstream heater 8*b*. Alternatively, the heater 8*b* may be extended by a sufficient length from below the print head 1 to the downstream direction in which the print sheet 6 is transported, as in the case with a heater 8*b*' in the variation shown in FIG. 1, so that the print sheet 6 is heated for a long time.

Figure 2:
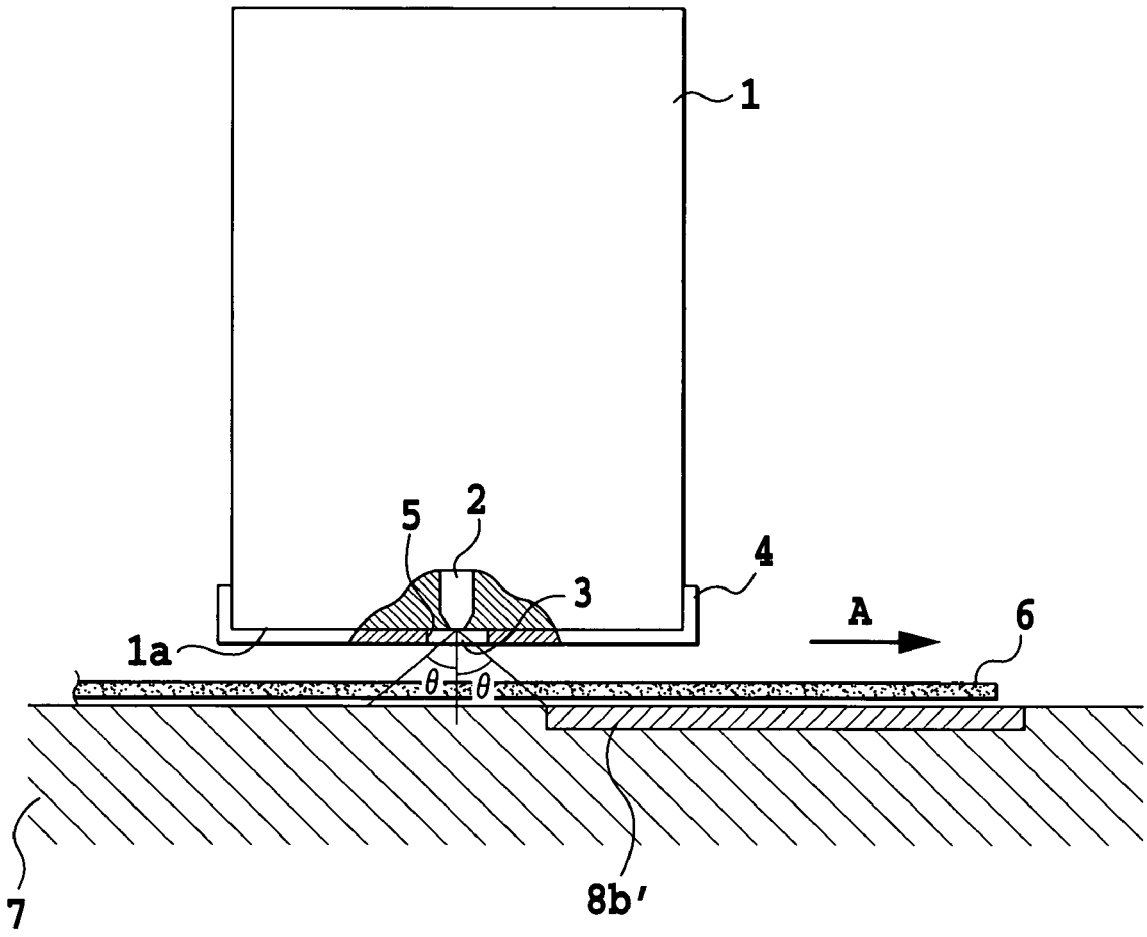
FIG. 2 is a diagram similar to FIG. 1 showing a variation of the printing apparatus of the present invention in FIG. 1.

FIGS. 3 to 6 show the arrangements of the nozzles 2 and ejection ports 3 in the print head 1 in Embodiment 1 of the printing apparatus of the present invention in FIG. 1, described above, and in the variation thereof in FIG. 2.

Figure 3:
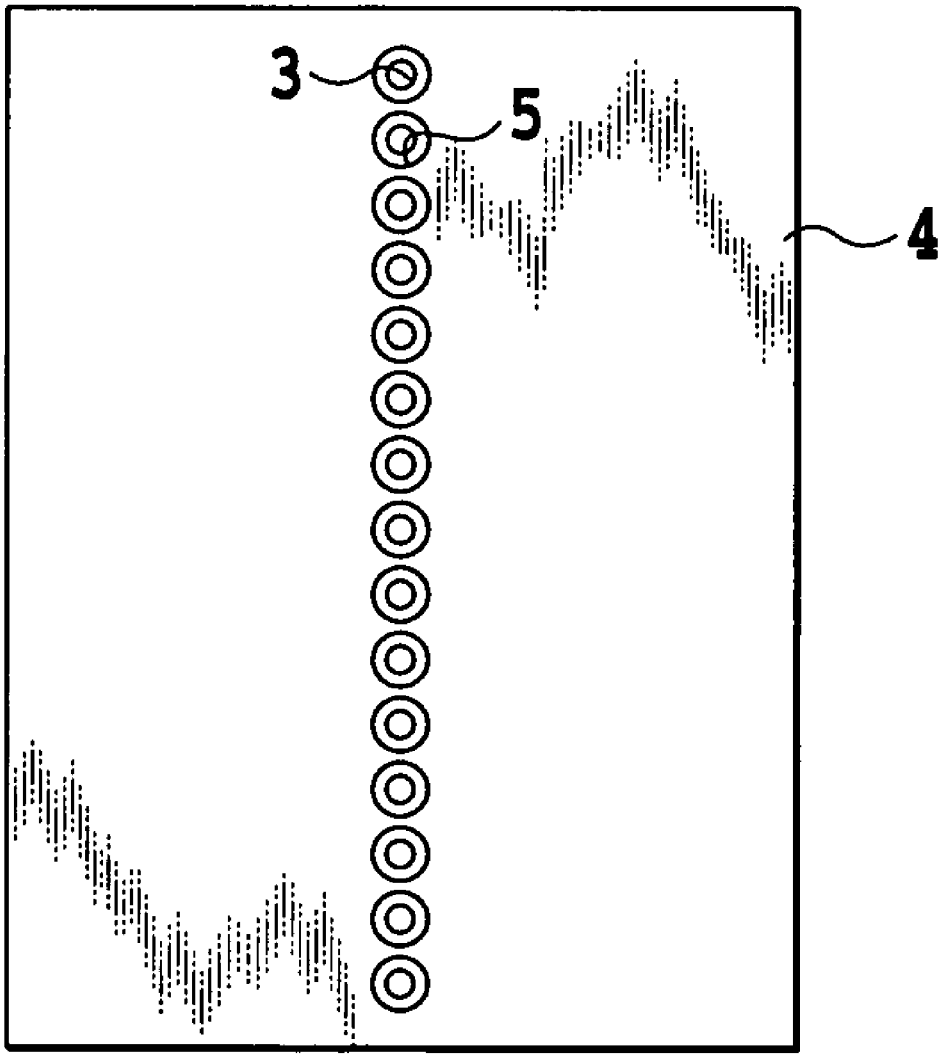
FIG. 3 is a bottom view showing the positional relationship between nozzles in the print head and through-holes in the heat reflecting plate in Embodiment 1 of the printing apparatus of the present invention.

First, the print head 1 shown in FIG. 3 has a plurality of nozzles 2 contiguously formed in the cross direction therein, and the ejection ports 3 located at the ends of the nozzles 2 are opened in the face 1*a* of the print head 1. The heat reflecting plate 4 adhered to the-face 1*a* of the print head 1 and also acting as both a heat conducting plate and a radiator plate, has the through-holes 5 formed contiguously therein and coaxially with the ejection ports 3 at specified intervals so as to correspond to the respective ejection ports 3.

Figure 4:
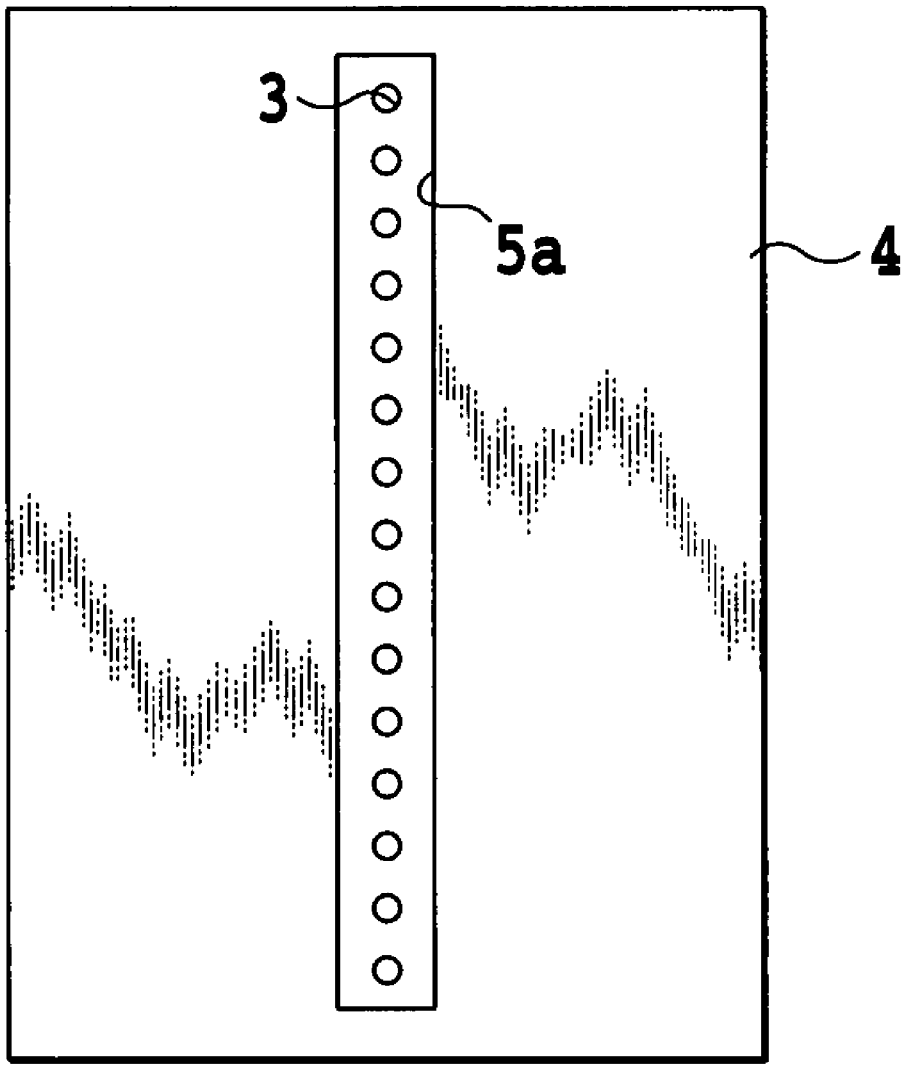
FIG. 4 is a bottom view showing another example of the positional relationship between the nozzles in the print head and the through-holes in the heat reflecting plate in Embodiment 1 of the printing apparatus of the present invention.
Figure 5:
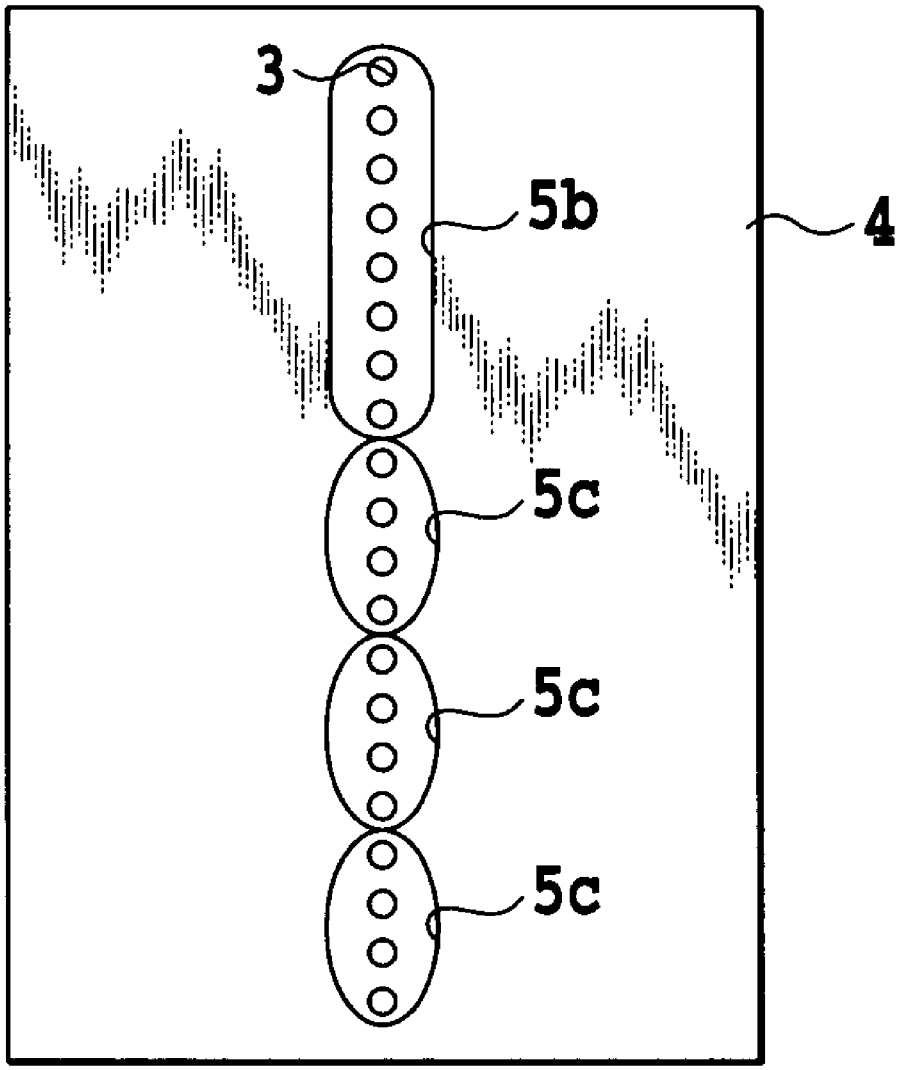
FIG. 5 is a bottom view showing yet another example of the positional relationship between the nozzles in the print head and the through-holes in the heat reflecting plate in Embodiment 1 of the printing apparatus of the present invention.
Figure 6:
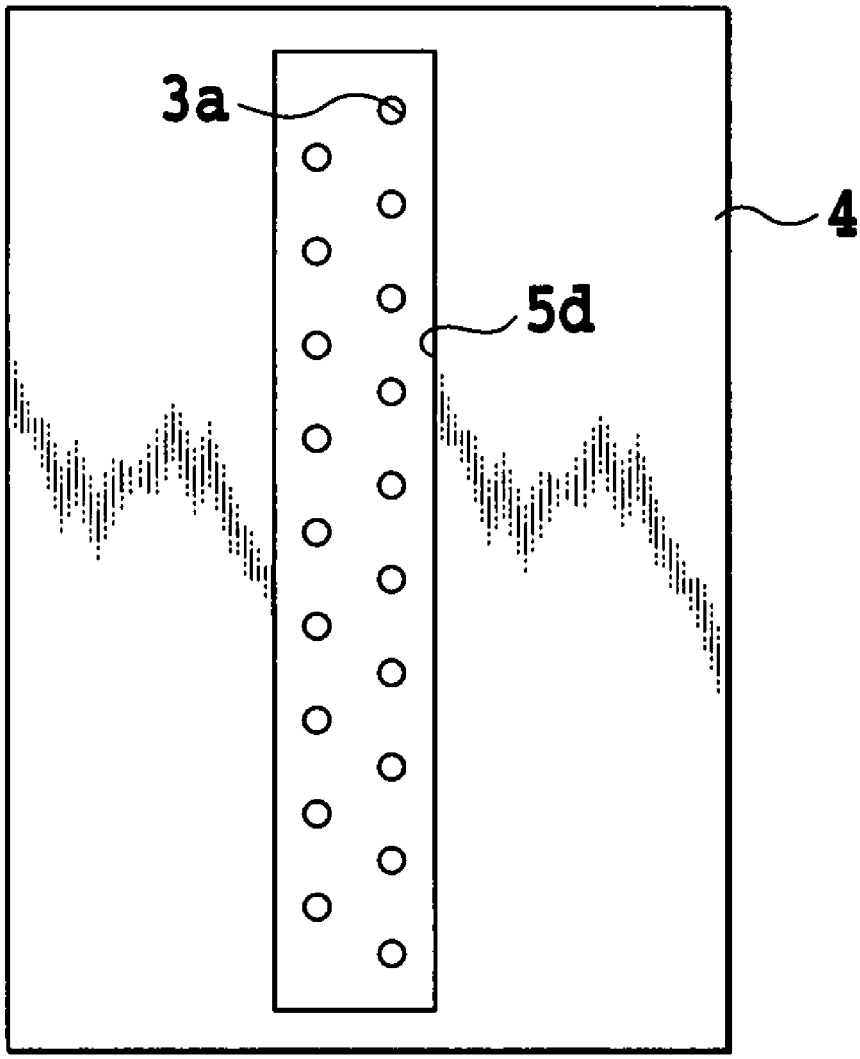
FIG. 6 is a bottom view showing still another example of the positional relationship between the nozzles in the print head and the through-holes in the heat reflecting plate in Embodiment 1 of the printing apparatus of the present invention.

In the print head 1 in FIG. 4, the heat reflecting plate 4 has a through-slot 5*a* formed therein and shaped like a rectangular elongated band so as to cover the contiguously arranged plurality of ejection ports 3. Further, in FIG. 5. the contiguously arranged ejection ports 3 are divided into groups each containing a number of ejection ports 3. To cover the divided ejection ports 3, the heat reflecting plate 4 has one slot-shaped through-hole 5*b* and a plurality of, in the illustrated embodiment, three elliptical through-holes 5*c* formed therein. Furthermore, in FIG. 6, ejection ports 3*a* are arranged zigzag, and one rectangular through-slot 5*d* is formed in the heat reflecting plate 4 so as to cover the zigzag ejection ports 3*a*. In this manner, the through-holes 5, 5*a*, 5*b*, 5*c*, and 5*d* can be properly arranged as shown in FIGS. 3 to 6 so as to correspond to the arrangement of the ejection ports 3 and 3*a*.

Furthermore, it is preferable that the heat reflecting plate 4, which also acts as both a heat conducting plate and a radiator plate, is suitably formed of aluminum or similar other metal material having a good heat reflectance and is shaped so as to suitably reflect heat. For example, the heat reflecting plate 4 can have its surfaces smoothed in order to appropriately reflect heat. Further, such a heat reflecting plate 4 is suitably formed and attached to protect the face 1*a* of the print head 1 and to cover the face 1*a* so as to achieve appropriate heat conduction, radiation, and reflection on the face 1*a*.

Figure 9:
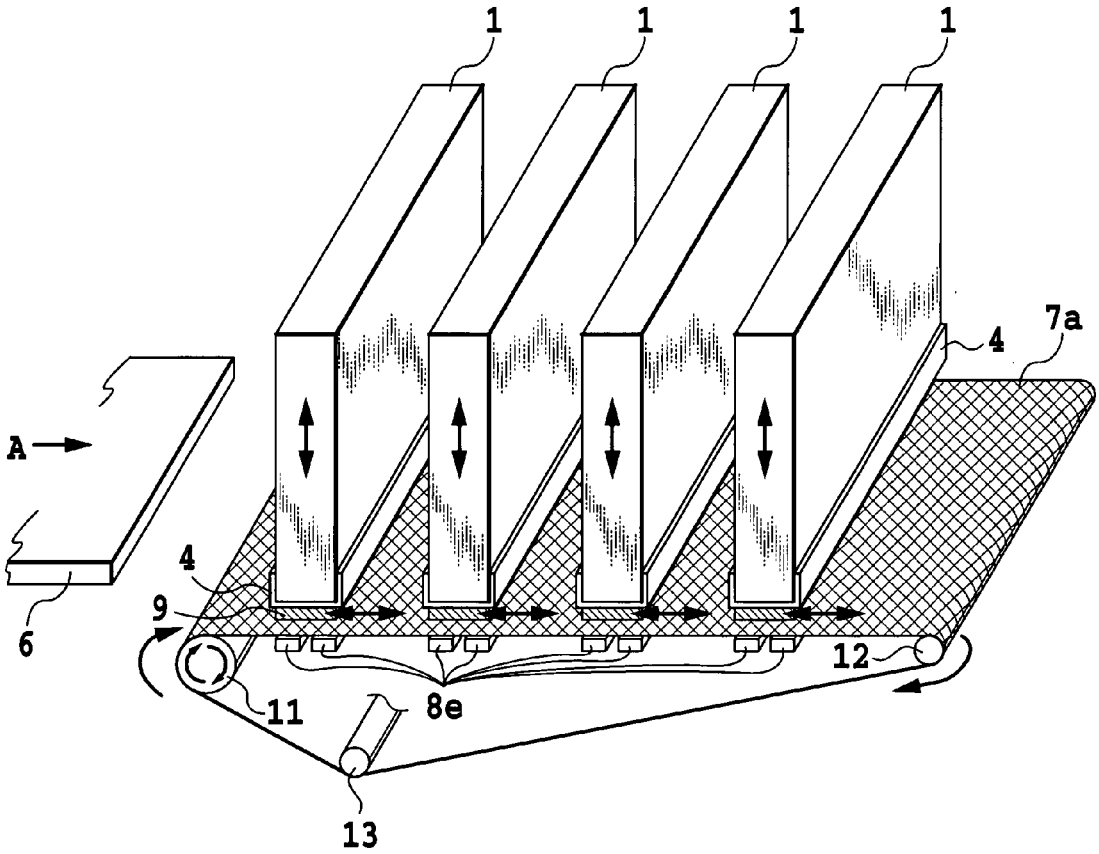
FIG. 9 is a perspective view showing Embodiment 4 of a printing apparatus of the present invention as well as a print head, a heater, a cap, and a transportation belt.

FIG. 9 shows a system that transports a printing medium in a full-multi-type printing apparatus according to the present invention, and it shows Embodiment 4 described later. With reference to FIG. 9, the entire construction of the printing apparatus of the present invention will be described in brief.

As shown in the figure, the printing apparatus of the present invention is generally composed of a plurality of print heads 1 of the full-multi-type and an endless transportation belt 7*a* that acts as a transportation mechanism for transporting printing medium. Printing is carried out by ejecting printing liquids from the print heads, onto a printing medium transported by the transportation belt 7*a*. In such a printing apparatus of the present invention, the print sheet 6 as a printing medium is placed on the transfer belt 7*a* as a transportation mechanism, and the transportation belt 7*a* is rotationally moved by an electric motor or the like to transport the print sheet 6 in a direction shown by an arrow A. Then, printing liquids are ejected from the print heads 1 onto the print sheet 6 being transported for printing.

As shown in FIG. 9, in the printing apparatus of the present invention, a plurality of sets of two heaters 8*e* are provided on the back surface of the transportation belt 7*a* with spaces provided therebetween, so as to correspond to one of the plurality of print heads 1, spaced at equal intervals. The print head 1 has the heat reflecting plate 4 mounted on the face 1*a* thereof and also acts as both a heat conducting plate and a radiator plate. Caps 9 are each provided on the back surface of the heat reflecting plate 4 so as to be movable in the transporting direction. The cap 9 covers the ejection port surface of the corresponding print head 1 while the head is not in use. The cap 9 can also be used to execute a recovery process as required. Further, with such print heads 1 according to the present invention, areas of the print sheet 6 corresponding to the areas between the print heads 1 as well as the printing liquid applied thereto can also be heated by the heaters 8*e*. Furthermore, the number of heaters 8*e* can be increased or reduced as required.

Further, in the printing apparatus of the present invention, shown in FIG. 9, the transportation belt 7*a* is composed of a mesh belt that transports the print sheet 6 as a printing medium so as to pass under the print heads 1. Then, under each print head 1, a printing liquid is ejected therefrom onto the print sheet 6 for printing. Furthermore, such a transportation belt 7*a* is composed of a mesh belt so as to be endless and is wound around a driving roller 11 rotationally driven in both directions by an appropriate drive device such as an electric motor and around a driven roller 12 and a tension roller 13. The transportation belt 7*a* is subjected to a desired tension by the tension roller 13, and is rotationally driven by the driving roller 11 to transport the print sheet 6 as a printing medium placed on the transportation belt 7*a*, in the direction of the arrow A.

Further, the top of the transportation belt 7*a* functions as a platen on which the print sheet 6 is placed, and the heaters 8*e* are installed immediately behind, i.e. immediately below a corresponding portion of the transportation belt 7*a* located opposite to the print head 1. Furthermore, instead of the mesh belt, a belt made of a film having a high heat transmissivity may be used as a transportation belt. Such a belt must be resistant to heat from the heaters 8*e*. The heaters 8*e* may be composed of ceramics or halogen heaters or nichrome wires. To reduce thermal diffusion from the heaters 8*e* in directions other than the one toward the print head 1, it is further preferable to provide a heat reflecting plate or a heat insulating material that covers the directions other than the one toward the print head 1.

(Embodiment 2)

In Embodiment 1, as described previously, no heaters are provided in the area of the platen 7 covered by the angles $\theta_1$ and $\theta_2$ with respect to the neighborhoods of the ejection ports 3 in the area in which the through-holes 5 in the heat reflecting plate 4 are open, as shown in FIG. 1, thereby substantially reducing the heat received by the neighborhoods of the ejection ports 3. But, in Embodiment 2, as shown in FIG. 7, a flat heater 8*c* is provided under the transportation belt 7*a*, provided immediately below the ejection ports 3 in place of a platen, and a heat reflecting plate 4*a* is adhered to the face 1*a* of the print head 1 so as to cover neighborhoods of the ejection ports 3, with a heat reflecting plate 4*b*, which also acts as both a heat conducting plate, and a radiator plate, provided between the heater 8*c* and the heat reflecting plate 4*a*.

Figure 7:
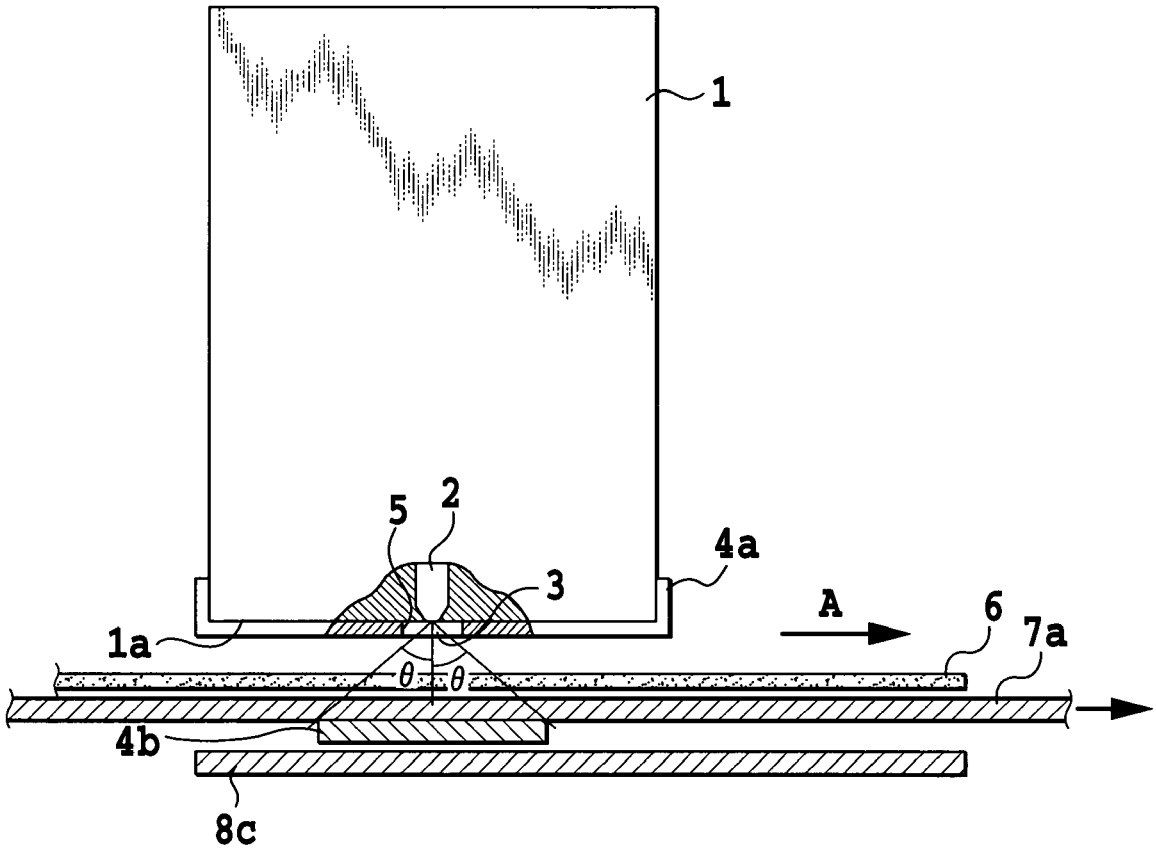
FIG. 7 is a partial sectional side view showing Embodiment 2 of a printing apparatus of the present invention as well as the positional relationship between a print head, a printing medium, a platen and a heater.

In Embodiment 2 in FIG. 7, the heat reflecting plate 4*b*, which also acts as both a heat conducting plate and a radiator plate, prevents heat from the heater 8*c* from reaching the neighborhoods of the ejection ports 3 of the print head 1. This arrangement enables a substantial reduction of the heat received by those portions of the heat reflecting plate 4*a* which are near the ejection ports 3, the heat reflecting plate having the through-holes 5 formed therein and also acting as a heat conducting plate and a radiator plate. This arrangement also enables suppression of an increase in temperature of the neighborhoods of the ejection ports 3. Accordingly, those areas of the heat reflecting plate 4*a* which are near the ejection ports 3 can be kept within an appropriate temperature range. The heat reflecting plates 4*a* and 4*b* also acting as both heat conducting plates and radiator plates can be composed of aluminum, which has a good heat reflectance and thermal conductivity, or similar other metal to increase the heat reflectance and heat conductivity, while suppressing the heat emission.

(Embodiment 3)

Figure 8:
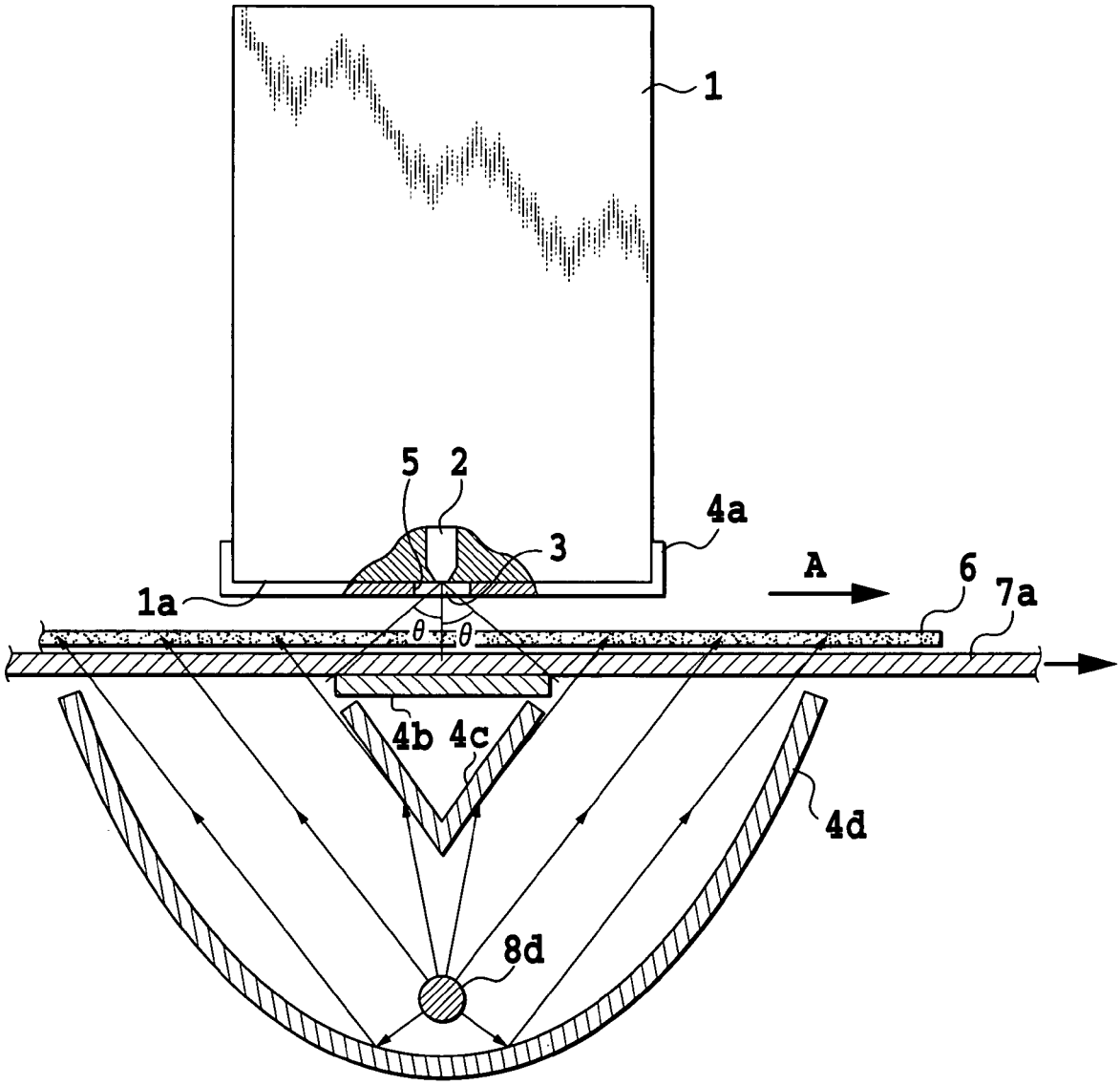
FIG. 8 is a partial sectional side view showing Embodiment 3 of a printing apparatus of the present invention as well as the positional relationship between a print head, a printing medium, a platen and a heater.

In Embodiment 2 in FIG. 7, the plate-like flat heater 8*c* is provided as a heater, but as shown in FIG. 8, in Embodiment 3 of the present invention, the following heat reflecting structure is provided. A bar-like elongate heater 8*d* is provided below the transportation belt 7*a* with a space therebetween in place of the platen provided immediately below the ejection ports 3. Further, the heat reflecting plate 4*a*, also acting as both a heat conducting plate and a radiator plate, is adhered to the face 1*a* of the print head 1 so as to cover the neighborhoods of the ejection ports 3, and a heat reflecting plate 4*b*, also acting as both a heat conducting plate and a radiator plate, is provided immediately below the transportation belt 7*a*, located immediately below the ejection ports 3. Then, heat is guided to the print sheet 6 on the transportation belt 7*a* via a heat reflecting plate 4*c* located immediately below the heat reflecting plate 4*b* and having a substantially V-shaped cross section and a heat reflecting plate 4*d* having a substantially parabolic cross section. Moreover, in such a heat reflecting structure, the inner surface of the heat reflecting plate 4*d* forms a heat reflection surface having a substantially parabolic cross section as shown in the figure. By thus properly setting the curved shape of the heat reflecting plate 4*d*, arrangements are possible in which heat from the heater 8*d* is appropriately reflected by the outer surface of the heat reflecting plate 4*c* having a substantially V-shaped cross section and the heat reflecting plate 4*d* having a substantially parabolic cross section as shown in the figure, for example, a non-printed portion of the printing medium 6 is preheated or heat is concentrated in a printed portion of the printing medium 6 for heating. To improve the heat reflection effect, the heater 8*d* is more suitably arranged at the center, i.e., the focus of the parabolic surface constituting the inner surface of the heat reflecting plate 4d of the heat reflecting structure.

(Embodiment 4)

In Embodiments 1 to 3, described above, for each print head 1, no heaters are provided in those areas of the heat reflecting plate 4 or 4*a* which are near the ejection ports 3 in the face 1*a* of the print head 1. Alternatively, the heater 8, 8*a*, 8*b*, 8*c*, or 8*d* is provided under the platen 7 or transportation belt 7*a*, and the heat reflecting plate 4 or 4*a* covering the neighborhoods of the ejection ports 3 is provided.

In contrast, in Embodiment 4, as shown in FIG. 9, the two heaters 8*e* are provided on the back surface of the transportation belt 7*a* with a space provided therebetween, so as to correspond to one of the plurality of print heads 1. Furthermore, the caps 9 are each provided on the back surface of the heat reflecting plate 4, which also acts as both a heat conducting plate and a radiator plate, so as to be movable in the transporting direction. The cap 9 covers the ejection port surface of the corresponding print head 1 while the head is not in use. The cap 9 can also be used to execute a recovery process as required. Furthermore, with such print heads 1, the number of heaters 8*c* can be increased or reduced as required, and areas of the print sheet 6 corresponding to the areas between the print heads 1 as well as the printing liquid applied thereto can also be heated by the heaters 8*e*.

Further, in this embodiment, the transportation belt 7*a* is composed of a mesh belt or the like so as to be endless and is wound around the driving roller 11 rotationally driven in both directions by an appropriate drive device such as an electric motor and around the driven roller 12 and the tension roller 13. The transportation belt 7*a* is subjected to a desired tension, and is rotationally driven to transport the print sheet 6 as a printing medium placed on the transportation belt 7*a*.

(Embodiment 5)

Figure 10:
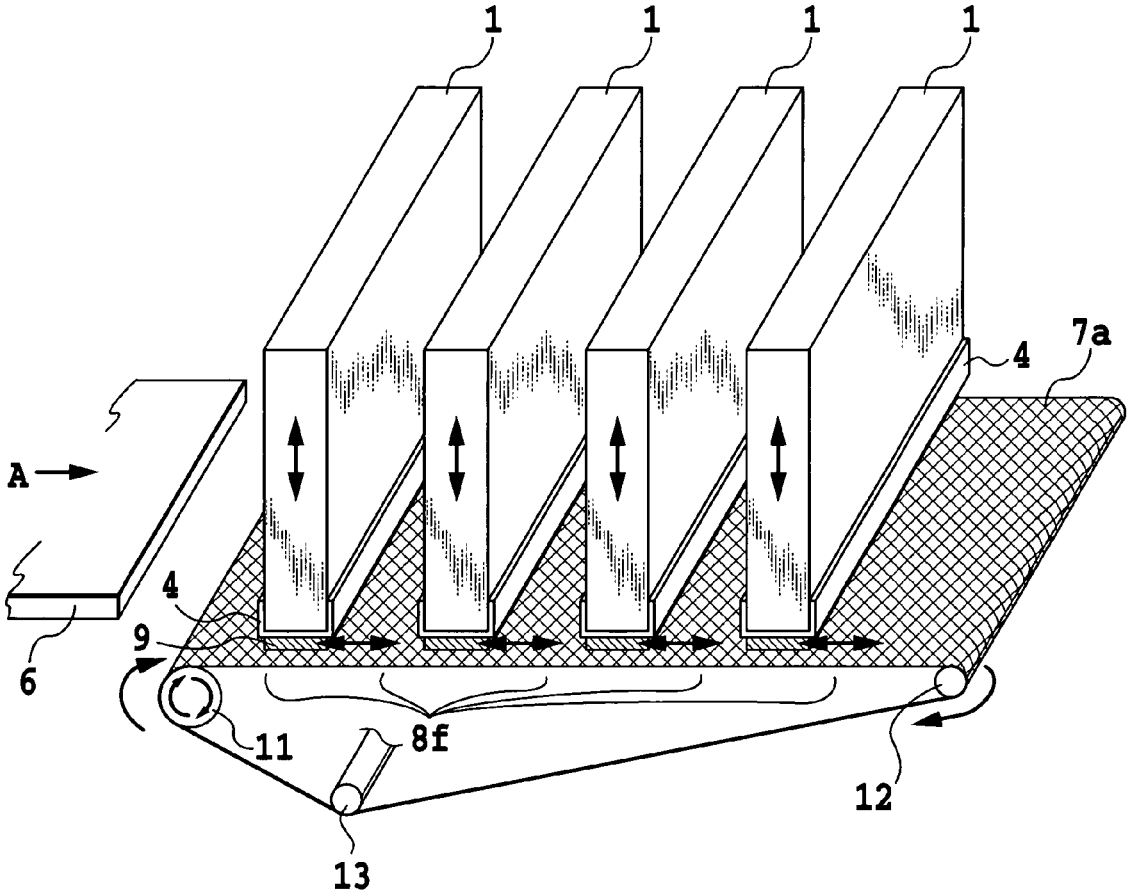
FIG. 10 is a similar perspective view showing Embodiment 5 of a printing apparatus of the present invention as well as a print head, a heater, a cap, and a transportation belt.

FIG. 10 shows Embodiment 5 in which no heaters are provided near the through-holes 5 in the heat reflecting plate 4, which are near the ejection ports 3 in the face of the print head 1, and heaters 8*f* are each provided on the back surface of the transportation belt 7*a* such as a mesh belt so as to cover a plurality of print heads 1. In this embodiment, compared to Embodiment 4 in FIG. 9, described previously, the number of heaters 8*f* can be dramatically reduced, thereby allowing appropriate heating and fixation of even areas of the print sheet 6 corresponding to the areas between the print heads 1 as well as the printing liquid applied thereto. Further, in increasing the temperature of the print sheet 6 or the printing liquid applied thereto or evaporating and drying the printing liquid, increasing heating time results in less problems associated with heat and is more effective than setting a higher temperature for the heaters 8*f* which may affect the print heads 1. Furthermore, in those areas in which the print head 1 in FIG. 10 is not present above the heater 8*f*, nothing covers the front surface of the printing medium 6 such as printing paper, and steam derived from the printing liquid is not likely to be filled in these areas. Furthermore, relative humidity remains lower, so that the printing liquid is prone to evaporate. Moreover, the caps 9 are each provided on the back surface of the heat reflecting plate 4, which also acts as both a heat conducting plate and a radiator plate, so as to be movable in the transporting direction. The cap 9 covers the ejection port surface of the corresponding print head 1 while the head is not in use.

(Embodiment 6)

Figure 11:
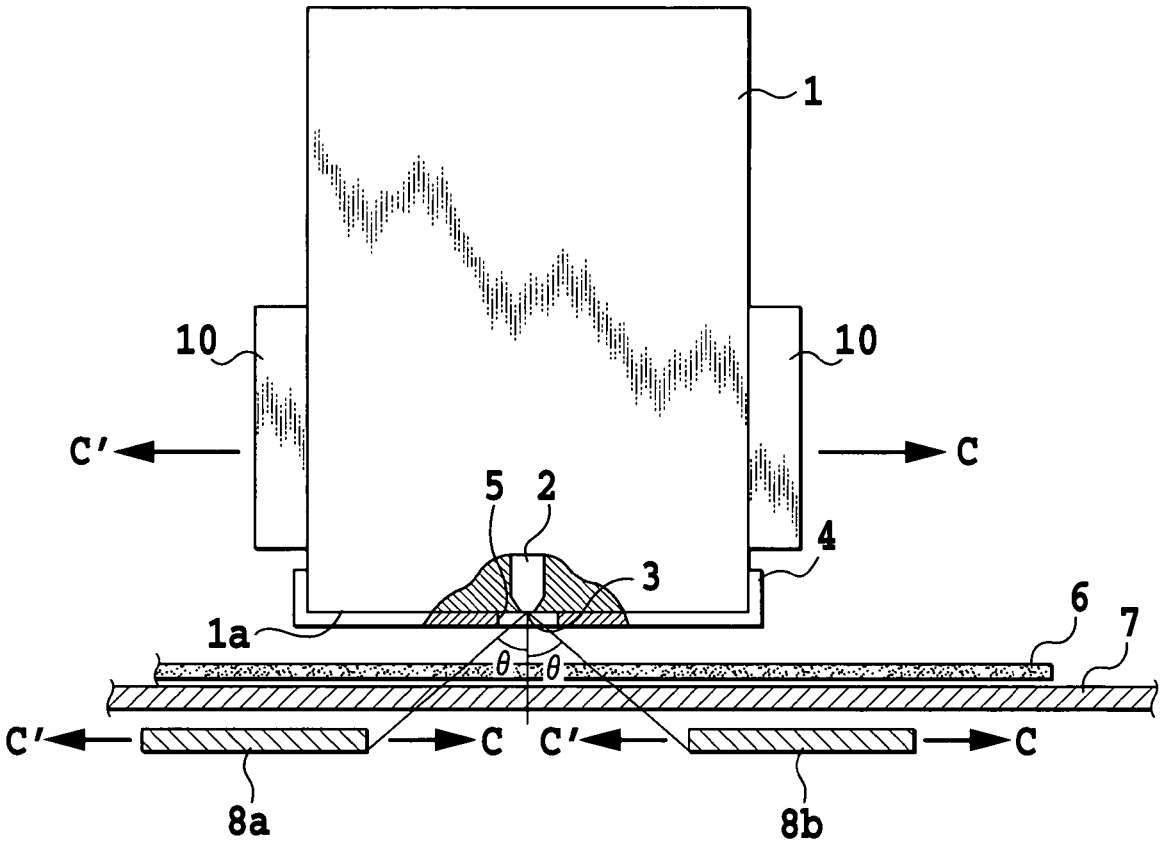
FIG. 11 is a partial sectional side view showing Embodiment 6 of a printing apparatus of the present invention as well as the positional relationship between a print head, a printing medium, a platen and a heater.

In Embodiments 1 to 5, the full-multi-type printing apparatus is assumed, but as shown in FIG. 11, in Embodiment 6, even in a serial printer, the heaters 8*a* and 8*b* may be moved in unison with movement of a carriage 10 with the print head 1 placed thereon, in directions C and C' under the platen 7 such as a mesh which is unlikely to store heat. Further, the heaters 8*a* and 8*b* are provided so as to move in unison with the print head 1 while maintaining a certain positional relationship with the print head 1. In a simpler configuration, the heaters 8*a* and 8*b* move while maintaining constant positions relative to the print head 1.

(Embodiment 7)

Figure 12:
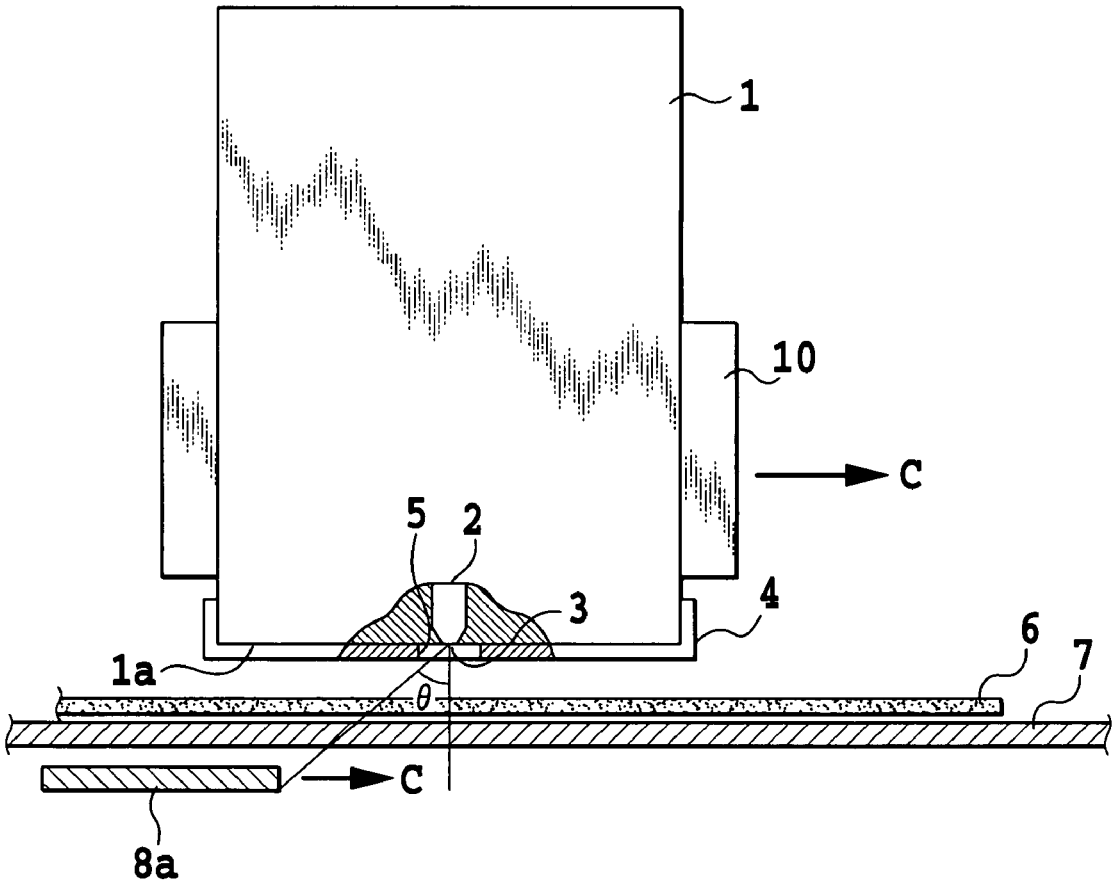
FIG. 12 is a partial sectional side view showing Embodiment 7 of a printing apparatus of the present invention as well as the positional relationship between a print head, a printing medium, a platen and a heater.
Figure 13:
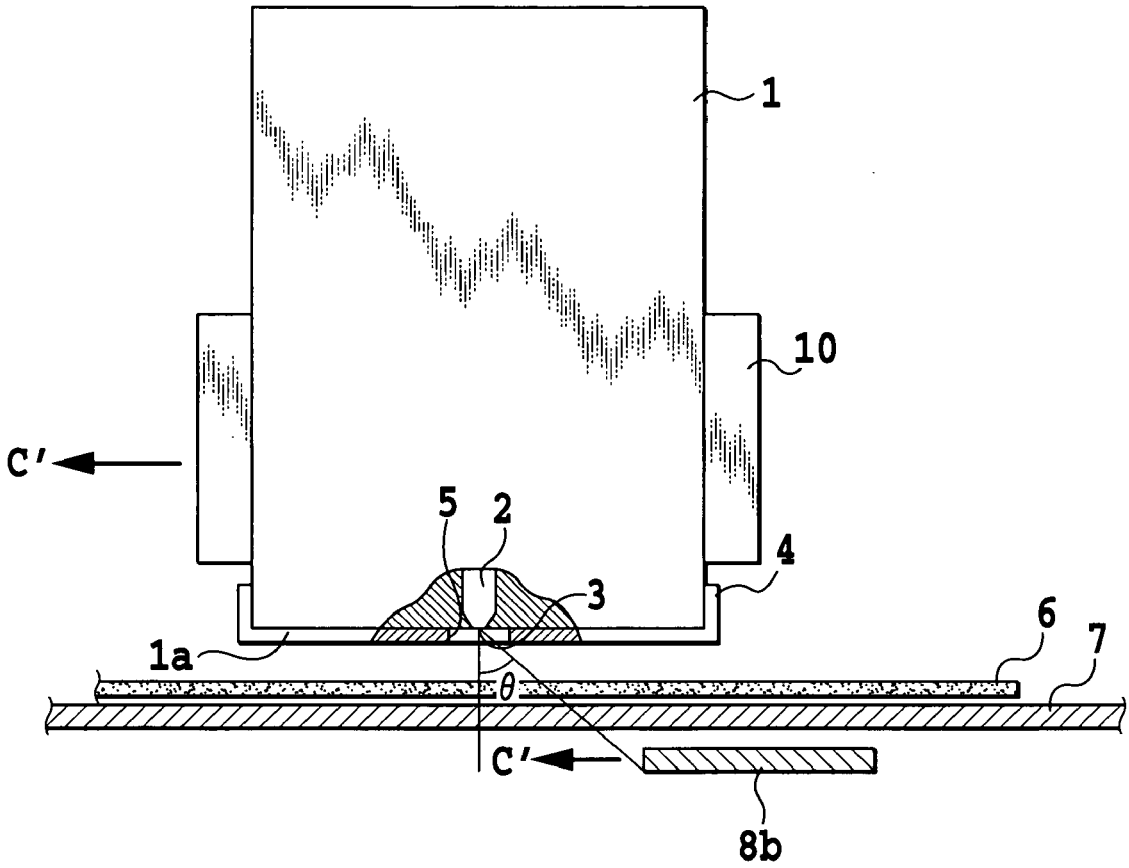
FIG. 13 is a similar partial sectional side view showing a backward path in Embodiment 7 in FIG. 12.

Further, in a printing apparatus that carries out bidirectional printing, the upstream and downstream heaters may have the same configuration with respect to movement of the carriage 10. Alternatively, as in Embodiment 7 in FIGS. 12 and 13, to ensure that movement of the carriage 10 allows the forward operation in FIG. 12 and the backward operation in FIG. 13 to always have such a positional relationship that only the just printed portion of the print sheet 6 is heated, the heaters 8*a* and 8*b* can be moved in unison with the movement of the print head 1 so as to keep the positions of the heaters 8*a* and 8*b* constant with respect to the print head 1.

Furthermore, the printing apparatus of the present invention may be in the form of an image output terminal of information processing equipment such as a computer, a copier combined with a reader or the like, or facsimile terminal equipment having transmitting and receiving functions.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus wherein a print head performs a printing operation by ejecting ink onto a first surface of a printing medium from ejection ports, said apparatus comprising:

a heater located near the print head for heating the printing medium from a second surface opposed to the first surface, wherein said heater is located so as to face the print head except for a location where ink ejected from the ejection ports lands onto the printing medium.

2. A printing apparatus according to claim 1 wherein said heater is located at a location downstream of a location where ink ejected from the ejection ports lands onto the printing medium.

3. A printing apparatus as claimed in claim 2, wherein the print head is of approximately the same width as the printing medium.

4. A printing apparatus as claimed in claim 1, wherein the print head is of approximately the same width as the printing medium.

5. A printing apparatus according to claim 1, wherein a portion of the printing medium which is located at a location closest to the ejection ports of the print head refers to a portion covered by a specified angle or larger with respect to a direction perpendicular to the ejection ports.

6. A printing apparatus as claimed in any one of claims 1 to 3, wherein a heat reflecting plate is provided on a surface of the print head which is opposite to said heater.

7. A printing apparatus as claimed in claim 6, wherein a thin metal film is attached to the print head as said heat reflecting plate.

8. A printing apparatus as claimed in claim 6, wherein metal is directly deposited on the surface of the print head to form a thin metal film as said heat reflecting plate.

9. A printing apparatus as claimed in claim 6, wherein an electric member with high reflectance is attached to the print head as said heat reflecting plate.

10. A printing apparatus as claimed in claim 6, wherein a material other than metal and which has a high heat reflectance is used as said heat reflecting plate.

11. A printing apparatus as claimed in any one of claims 1 to 3, wherein a plate is provided on a surface of the print head which is opposite to said heater.

12. A printing apparatus as claimed in claim 11, wherein said plate functions as at least one of a heat reflecting plate, a heat conducting plate, and a radiator plate.

13. A printing apparatus as claimed in claim 12, wherein a metal plate is attached to the print head so as to function as at least one of the heat reflecting plate, the heat conducting plate and the radiator plate.

14. A printing apparatus as claimed in claim 11, wherein the surface of the print head is partially or entirely composed of metal.

15. A printing apparatus as claimed in any one of claims 1 to 3, further comprising a heat reflecting plate provided on a nozzle face of the print head or on the nozzle face and on areas of the print head which are near the nozzle face, with said heater being opposed to the print head, wherein the printing medium is passed between said heat reflecting plate on the nozzle face and said heater, so that part of heat from said heater which has been transmitted through the printing medium is reflected by said heat reflecting plate, and the reflected heat is used to further heat the printing medium.

16. A printing apparatus as claimed in any one of claims 1 to 3, further comprising a heat reflecting plate provided on a nozzle face or on the nozzle face and on areas of the print head which are near the nozzle face, with said heater being opposed to the print head, wherein the printing medium is passed between said heat reflecting plate on the nozzle face and said heater so that part of heat from said heater which has been transmitted through the printing medium is reflected by said heat reflecting plate, and the reflected heat is used to further heat the printing medium, while reflected heat transmitted through the printing medium is returned to said heater.

17. A printing apparatus as claimed in claim 1, wherein a material with high heat reflectance is applied directly to the surface of the print head to form a thin heat-reflecting film opposite to said heater.

18. A printing apparatus as claimed in any one of claims 1 to 3, wherein aqueous ink is used therein.

19. A printing apparatus wherein a print head performs a printing operation by ejecting ink onto a first surface of a printing medium, said apparatus comprising:

heating means located near the print head for heating the printing medium from a second surface opposed to the first surface, wherein said heating means is located so as to face the print head and wherein said heating means heats a portion of the printing medium located close to ink ejection ports of the print head except for a portion on which ink ejected from the ejection ports lands.

20. A printing apparatus as claimed in claim 10, wherein the print head is of approximately the same width as the printing medium.

21. A printing apparatus as claimed in claim 20, further comprising a heat reflecting plate provided on a nozzle face of the print head or on the nozzle face and on areas of the print head which are near the nozzle face, with said heating means being opposed to the print head, wherein the printing medium is passed between said heat reflecting plate on the nozzle face and said heating means, so that a portion of heat from said heating means which has been transmitted through the printing medium is reflected by said heat reflecting plate, and the reflected heat is used to further heat the printing medium.

22. A printing apparatus as claimed in claim 21, wherein a thin metal film is attached to the print head as said heat reflecting plate.

23. A printing apparatus as claimed in claim 21, wherein an electric member with high reflectance is attached to the print head as said heat reflecting plate.

24. A printing apparatus as claimed in claim 19, wherein a plate is provided on a surface of the print head.

25. A printing apparatus as claimed in claim 24, wherein said plate functions as at least one of a heat reflecting plate, a heat conduction plate, and a radiator plate.

26. A printing apparatus as claimed in claim 19, wherein aqueous ink is used in the print head.

* * * * *

UNITED STATES PATENT AND TRADEMARK OFFICE

CERTIFICATE OF CORRECTION

PATENT NO. : 7,004,578 B2
APPLICATION NO. : 10/173854
DATED : February 28, 2006
INVENTOR(S) : Hitoshi Tsuboi et al.

It is certified that error appears in the above-identified patent and that said Letters Patent is hereby corrected as shown below:

COLUMN 5
Line 45, "is-attached" should read --is attached--.

COLUMN 7
Line 28, "heads" should read --head,--.

COLUMN 15
Line 16, "claim 1" should read --claim 1,--.
Line 32, "3" should read --4--.
Line 47, "3" should read --4--.
Line 60, "3" should read --4--.

COLUMN 16
Line 7, "3" should read --4--.
Line 23, "3" should read --4--.

Signed and Sealed this

Twenty-fourth Day of July, 2007

JON W. DUDAS
*Director of the United States Patent and Trademark Office*